US006666045B1

(12) United States Patent
Song

(10) Patent No.: US 6,666,045 B1
(45) Date of Patent: Dec. 23, 2003

(54) KIMCHI REFRIGERATOR

(75) Inventor: Yo-Hyun Song, Kwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/361,639

(22) Filed: Feb. 11, 2003

(30) Foreign Application Priority Data

Jun. 28, 2002 (KR) ..... 2002-36568
Sep. 19, 2002 (KR) ..... 2002-57157

(51) Int. Cl.[7] ..... F25D 11/02
(52) U.S. Cl. ..... 62/441; 62/452
(58) Field of Search ..... 62/428, 452, 508, 62/404, 407, 408, 441, 440; 6/11

(56) References Cited

U.S. PATENT DOCUMENTS 4,355,521 A * 10/1982 Tsai ..... 62/196
5,351,745 A * 10/1994 Park ..... 165/30
5,388,427 A * 2/1995 Lee ..... 62/331
5,398,599 A * 3/1995 Woo ..... 99/468
5,421,247 A * 6/1995 Shim ..... 99/468
5,458,186 A * 10/1995 Lee et al. ..... 165/30
5,570,587 A * 11/1996 Kim ..... 62/331
5,752,568 A * 5/1998 Lee ..... 165/206
5,782,106 A * 7/1998 Park ..... 62/452
5,881,567 A * 3/1999 Junge et al. ..... 62/428

FOREIGN PATENT DOCUMENTS

KR 1994-6970 8/1994

* cited by examiner

*Primary Examiner*—Melvin Jones
(74) *Attorney, Agent, or Firm*—Staas & Halsey LLP

(57) ABSTRACT

A kimchi refrigerator which is capable of effectively using an interior storage space. The kimchi refrigerator includes a cabinet with two or more storage compartments provided in the cabinet storing kimchi and a machine room which is located in the cabinet and houses electrical devices. The machine room is arranged from a front of the cabinet to the rear of the cabinet at a position under one of the storage compartments, thus enlarging an interior storage space of one or more storage compartments under which the machine room is not located.

34 Claims, 5 Drawing Sheets

KIMCHI REFRIGERATOR

CROSS-REFERENCE TO RELATED APPLICATIONS

This application claims the benefit of Korean Application No. 2002-36568, filed Jun. 28, 2002, and Korean Application No. 2002-57157, filed on Sep. 19, 2002 in the Korean Intellectual Property Office, the disclosures of which are incorporated herein by reference.

BACKGROUND OF THE INVENTION

1. Field of the Invention

The present invention relates generally to a kimchi refrigerator, and more particularly, to a kimchi refrigerator which is capable of effectively using an interior storage space.

2. Description of the Related Art

A kimchi refrigerator is an appliance used to store kimchi at low temperatures. Generally, the kimchi refrigerator is provided with a ripening device to ripen the kimchi and a cooling device to store kimchi cool, thus accomplishing the ripening and storage of kimchi.

As shown in FIG. 1, a kimchi refrigerator comprises a cabinet 1 which defines an appearance of the kimchi refrigerator. A storage compartment 2 to store kimchi is defined in the cabinet 1. The storage compartment 2 is open at a top and through the opening at the top, food including kimchi can be put into the storage compartment 2. The kimchi refrigerator has a door 3 so as to selectively close the opening at the top of the storage compartment 2.

The cabinet 1 of the kimchi refrigerator is provided on a lower portion with a machine room 4. The machine room 4 houses several electrical devices to operate the kimchi refrigerator.

The machine room 4 occupies an entire area of a lower portion of the cabinet 1. A capillary tube (not shown), a compressor 4*a*, a blowing fan 4*b*, and a condensing heat exchanger 4*c* are located in the machine room 4. The compressor 4*a* is used to compress a refrigerant. The blowing fan 4*b* sucks and discharges outside air. The condensing heat exchanger 4*c* transfers heat to the outside air flowing into the machine room 4, thereby condensing the refrigerant.

Air inlet holes 1 a and air outlet holes 1*b* are provided on a rear wall of the machine room 4. The outside air flows into the machine room 4 through the air inlet holes 1*a*. Thereafter, air which passes through the condensing heat exchanger 4*c* is discharged through the air outlet holes 1*b* formed on a rear wall of the cabinet 1. That is, the kimchi refrigerator is designed such that air flows into the machine room 4 through the rear wall of the cabinet 1, and is discharged through the rear wall of the cabinet 1 after the condensing heat exchanger 4*c* transfers heat to the outside air flowing into the machine room 4.

However, the conventional kimchi refrigerator is problematic in that a machine room 4 occupies the entire lower portion of the cabinet 1. Thus, a space required to house the machine room 4 is too large, so the storage compartment 2 to store kimchi is undesirably small considering a size of the cabinet 1.

Further, the outside air is sucked through the air inlet holes 1*a* provided on the rear wall of the cabinet 1 and then is discharged through the air outlet holes 1*b* provided on the rear wall of the cabinet 1. Since high-temperature air, which has absorbed heat from the condensing heat exchanger 4*c*, is discharged through the rear wall of the cabinet 1, air temperature around the rear wall is high. Thus, a portion of the discharged hot air is sucked again through the rear wall, thus reducing a heat exchanging efficiency or cooling efficiency of the condensing heat exchanger 4*c*.

SUMMARY OF THE INVENTION

Accordingly, a kimchi refrigerator is provided, which has a sufficiently large interior storage space.

Further, a kimchi refrigerator is provided which is capable of further increasing a cooling efficiency of the kimchi refrigerator.

Additional aspects and advantages of the invention will be set forth in part in the description which follows and, in part, will be obvious from the description, or may be learned by practice of the invention.

In order to accomplish the above and/or other aspects, a kimchi refrigerator comprises a cabinet, two or more storage compartments provided in the cabinet to store kimchi, and a machine room provided in the cabinet to house electrical devices, wherein the machine room is arranged from a front to a rear of the cabinet at a position under one of the storage compartments.

One or more storage compartments, under which the machine room is not located, are formed such that a bottom of the one or more storage compartments is/are deeper than a bottom of the one storage compartment which is positioned above the machine room.

The machine room includes a compressor, which compresses a refrigerant, a condensing heat exchanger, which transfers heat to outside air flowing into the machine room, thereby condensing the refrigerant, and a blowing fan which sucks the outside air into the machine room and discharges air which has passed through the condensing heat exchanger to an outside.

The condensing heat exchanger, blowing fan, and compressor may be sequentially arranged in the machine room in a direction from the front of the machine room to the rear of the machine room. Alternatively, the condensing heat exchanger, compressor, and blowing fan may be sequentially arranged in the machine room in a direction from the front of the machine room to the rear of the machine room.

In addition, an air inlet hole is provided at a lower portion of the front of the machine room so as to suck the outside air into the machine room, and an air outlet hole is provided at the rear of the machine room discharging air which has passed through the condensing heat exchanger to the outside.

A guide member is provided between the condensing heat exchanger and the compressor to close a gap between the blowing fan and inner walls of the machine room, with a through hole formed on the guide member which allows the blowing fan to be mounted in the through hole.

A blocking member is provided in the machine room, such that the blocking member closes a gap between the condensing heat exchanger and the inner walls of the machine room, thus allowing the outside air flowing into the machine room to pass through the condensing heat exchanger.

Air inlet holes may be provided on a front of a lower surface of the cabinet defining a lower surface of the machine room, and air outlet holes may be provided on a lower portion of the rear surface of the cabinet defining a rear surface of the machine room.

Further, a subsidiary air inlet hole is provided at a predetermined position on the lower portion of the machine room so as to sufficiently suck the outside air into the machine room, and a guide rib is provided at a position around the subsidiary air inlet hole so as to guide the outside air to the condensing heat exchanger.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
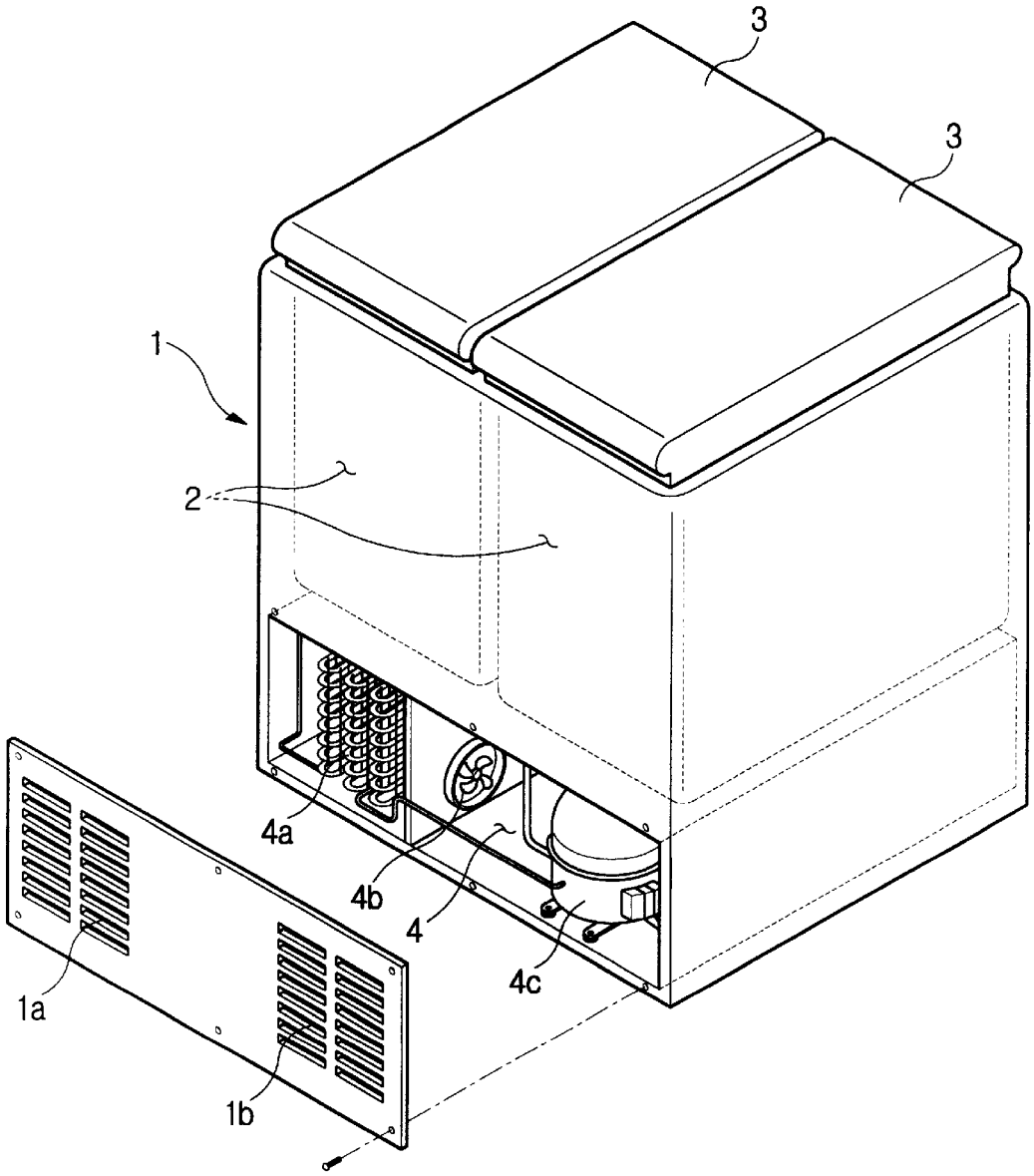
FIG. 1 (PRIOR ART)
FIG. 1 is a perspective view showing a conventional kimchi refrigerator.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
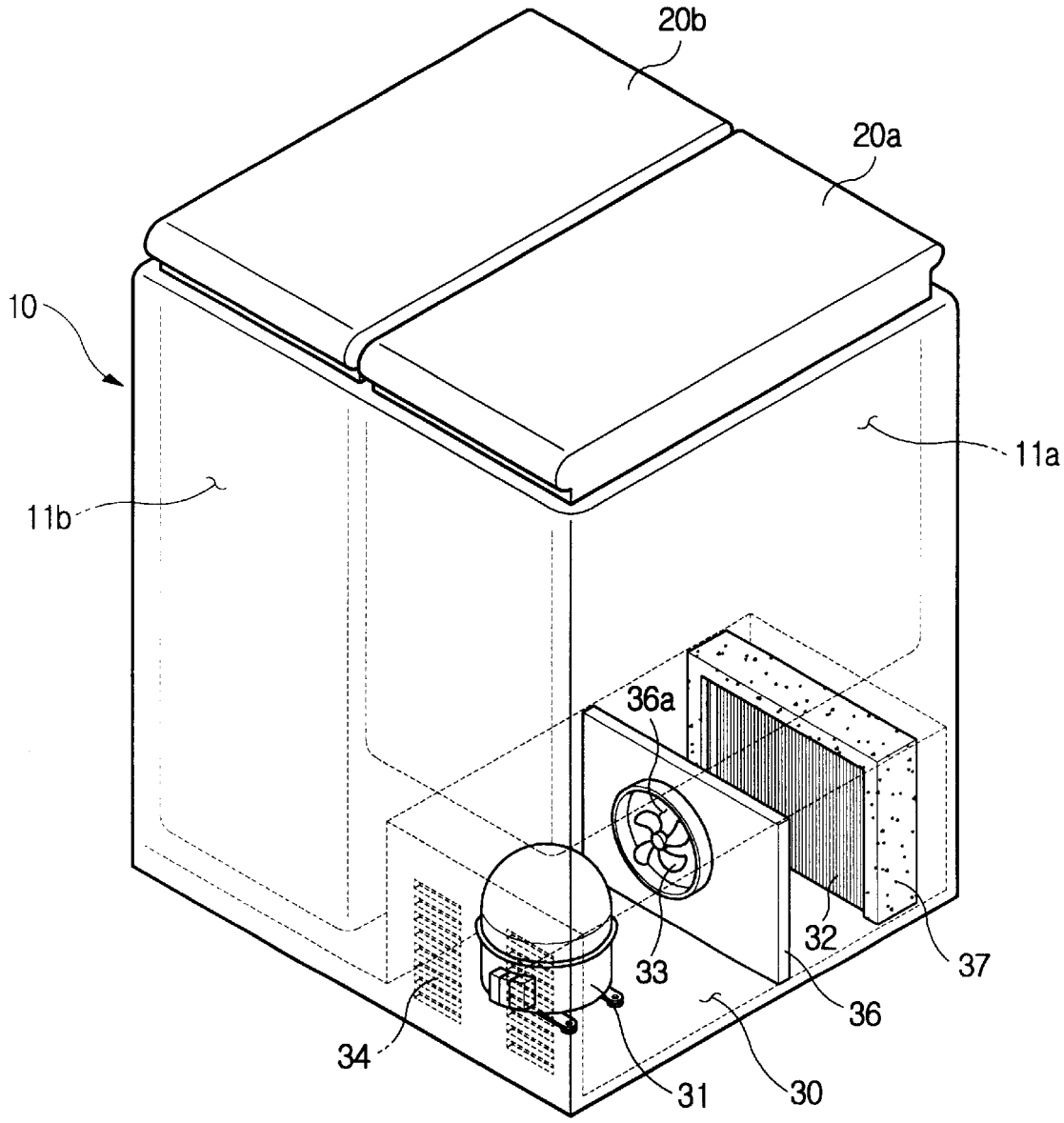
FIG. 2 is a perspective view of a kimchi refrigerator according to an embodiment of the present invention.
Figure 3:
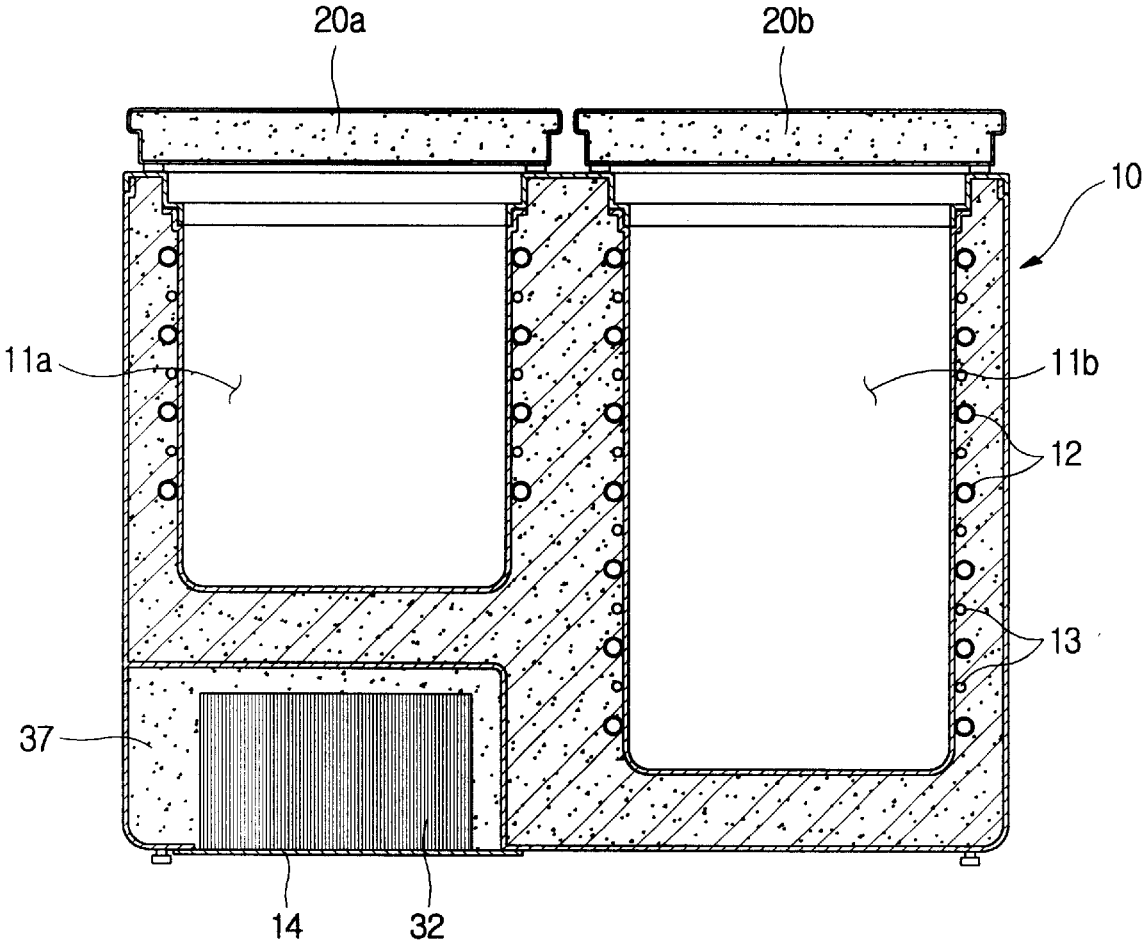
FIG. 3 is a sectional view of the kimchi refrigerator of FIG. 2.

As shown in FIGS. 2 and 3, a kimchi refrigerator comprises a cabinet 10 which defines an appearance of the kimchi refrigerator. Two storage compartments 11*a* and 11*b* are defined in the cabinet 10, and each of the storage compartments 11*a* and 11*b* has an opening formed at a top thereof. Two doors 20*a* and 20*b* are mounted to the top of the cabinet 10 so as to selectively close the openings formed at the top of the storage compartments 11*a* and 11*b*, respectively.

The kimchi refrigerator is provided with a cooling device to cool the storage compartments 11*a* and 11*b*, and a ripening device to ripen kimchi stored in the storage compartments 11*a* and 11*b*. The cooling device comprises a refrigerant pipe 12, which is installed on an outside wall of each of the storage compartments 11*a* and 11*b* so as to serve as an evaporating heat exchanger. The ripening device comprises an electric heating wire 13, which is installed so as to surround the outside wall of each of the storage compartments 11*a* and 11*b*.

One compartment of the two storage compartments 11*a* and 11*b* is provided on a right side of the kimchi refrigerator, while a second storage compartment of the two storage compartments 11*a* and 11*b* is provided on a left of the kimchi refrigerator. A machine room 30 is provided below one of the storage compartments 11*a*, and houses several electrical devices operating the kimchi refrigerator. The storage compartment 11*b* under which the machine room 30 is not located is formed such that a bottom of the storage compartment 11*b* is deeper than a bottom of the storage compartment 11*a* which is positioned above the machine room 30. Thus, a size of the storage compartment 11*b* is relatively larger than that of the storage compartment 11*a* under which the machine room 30 is located.

A capillary tube (not shown), a compressor 31, a condensing heat exchanger 32, and a blowing fan 33 are located in the machine room 30. The compressor 31 is used to compress a refrigerant. The condensing heat exchanger 32 transfers heat to outside air, thereby condensing the refrigerant. The blowing fan 33 sucks the outside air into the machine room 30, and discharges air which has passed through the condensing heat exchanger 32 to an outside.

The condensing heat exchanger 32, the blowing fan 33, and the compressor 31 are sequentially arranged in the machine room 30 in a direction from a front to a rear of the cabinet 10.

Figure 4:
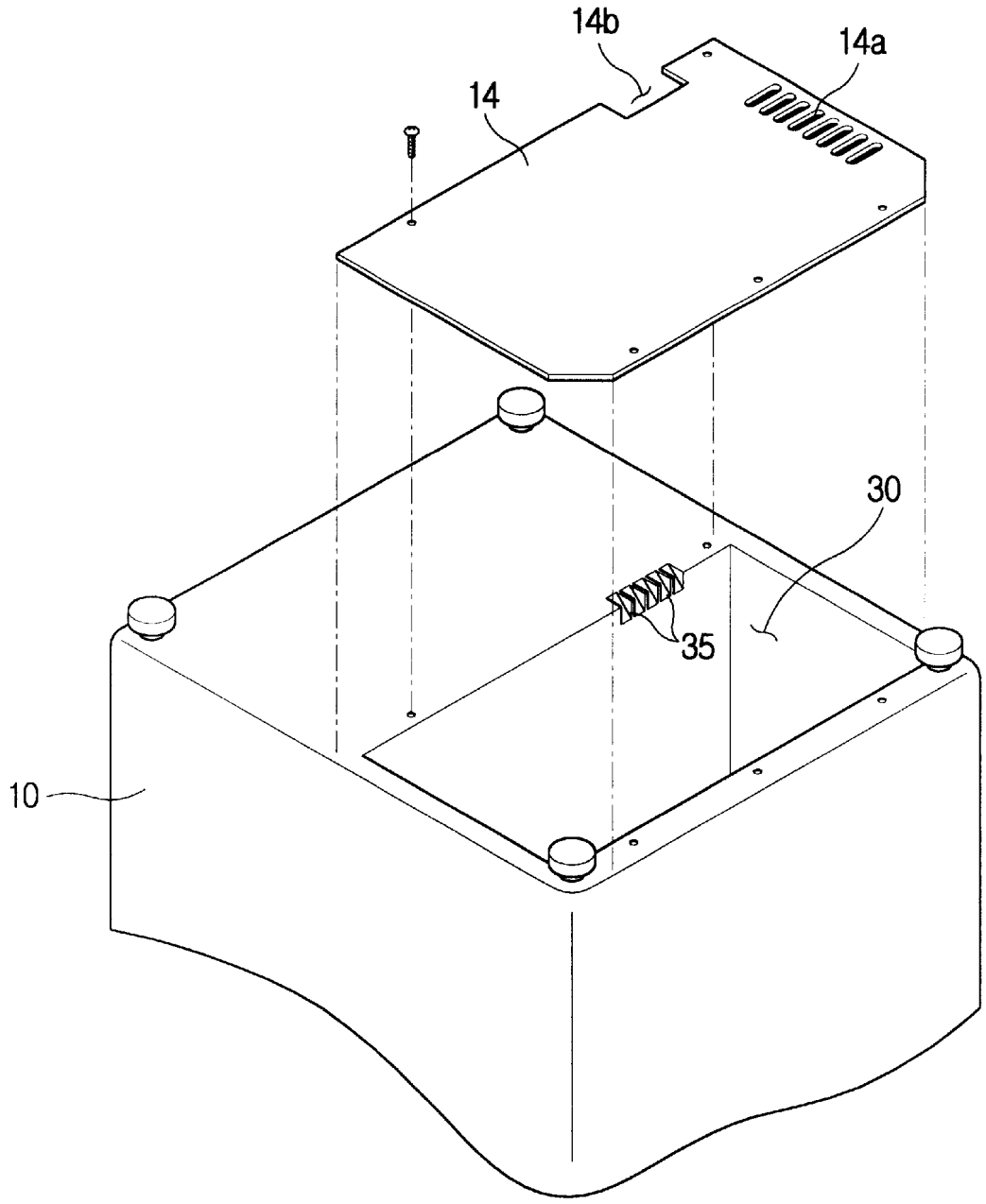
FIG. 4 is a bottom perspective view of the kimchi refrigerator of FIG. 2.

As shown in FIG. 4, air inlet holes 14*a* are provided on a front of the machine room 30 so as to suck the outside air into the machine room 30. Air outlet holes 34, as shown in FIG. 2, are provided on a rear of the machine room 30 so as to discharge air, which has absorbed the heat from the condensing heat exchanger 32, to the outside. The air inlet holes 14*a* are formed on a front of a lower surface of the machine room 30, and the air outlet holes 34 are formed on a rear surface of the machine room 30 for aesthetic purposes.

In addition to the air inlet holes 14*a* provided on the front of the machine room 30, a subsidiary air inlet hole 14*b* is provided at a predetermined position on a lower portion of the machine room 30, thus allowing a sufficient amount of the outside air to flow into the machine room 30. The subsidiary air inlet hole 14*b* is provided on a bottom plate 14 which forms the bottom of the machine room 30. A plurality of guide ribs 35 are provided on an inner wall of the machine room 30 at a position around the subsidiary air inlet hole 14*b* when the bottom plate 14 is mounted to the bottom of the cabinet 10, so as to guide outside air to the condensing heat exchanger 32.

Further, a guide member 36 and a blocking member 37 are provided in the machine room 30 by the blowing fan 33. The guide member 36 partitions an internal space of the machine room 30 into two sections so as to effectively move air in the machine room 30 by the blowing fan 33. The blocking member 37 allows a heat-exchanging process to be effectively carried out in the condensing heat exchanger 32.

The guide member 36 is installed between the compressor 31 and the condensing heat exchanger 32. The guide member 36 closes a gap between the blowing fan 33 and the inner walls of the machine room 30, so that the outside air flowing into the machine room 30 is effectively blown by the blowing fan 33. The guide member 36 has a through hole 36*a* provided on a central portion thereof. The blowing fan 33 is mounted in the through hole 36*a*.

The blocking member 37 closes a gap between the condensing heat exchanger 32 and the inner walls of the machine room 30, so that most of the outside air flowing into the machine room 30 passes through the condensing heat exchanger 32, thus increasing a heat exchanging efficiency or a cooling efficiency.

The two storage compartments 11*a* and 11*b* are provided on the left and right sides of the cabinet 10, respectively. However, three or more storage compartments may be defined in the cabinet 10 and a machine room may be defined under one storage compartment of the three or more storage compartments and in a direction from the front of the cabinet 10 to the rear of the cabinet 10.

Further, according to the embodiments of the present invention, the condensing heat exchanger 32, the blowing fan 33, and the compressor 31 are sequentially arranged in the machine room 30 in a direction from the front of the machine room 30 to the rear of the machine room 30, but this arrangement may be changed without being limited to the above-mentioned arrangement.

Figure 5:
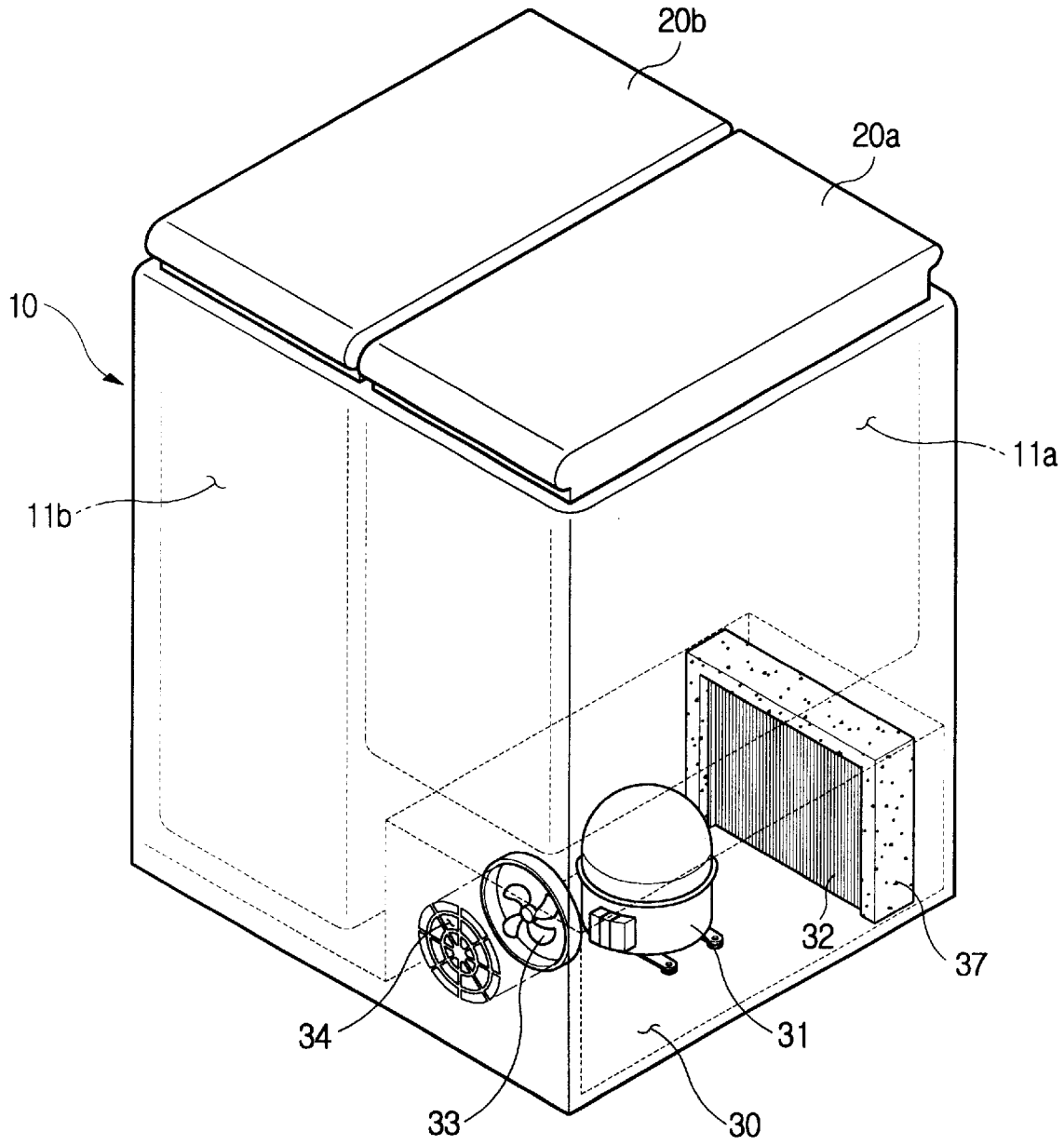
FIG. 5 is a perspective view showing a kimchi refrigerator according to a second embodiment of the present invention.

FIG. 5 shows a kimchi refrigerator according to a second embodiment of the present invention. As shown in FIG. 5, the blowing fan 33 may be installed in the machine room 30 so as to be adjacent to the air outlet holes 34 which are provided on the rear of the machine room 30. Thus, the condensing heat exchanger 32, the compressor 31, and the blowing fan 33 are sequentially arranged in the machine room 30 in a direction from the front of the machine room 30 to the rear of the machine room 30.

Furthermore, the embodiments of the present invention have been described with reference to the kimchi refrigerator, but the present invention may be applied to machine rooms of various apparatuses which keep food cool by using a refrigerating cycle, such as a standard type refrigerator, without being limited to the kimchi refrigerator.

The operation and effect of the kimchi refrigerator according to the present invention will be described in detail in the following and with reference to the drawings.

The machine room 30 is defined under one of the two storage compartments 11*a* and 11*b* in a direction from the front of the kimchi refrigerator to the rear of the kimchi refrigerator, thus enlarging an interior storage space of the storage compartment 11*b* under which the machine room 30 is not located.

When the blowing fan 33 is rotated by an operation of the kimchi refrigerator, the outside air flows into the machine room 30 through the air inlet holes 14*a* and the subsidiary air inlet hole 14*b*, which are provided on the lower portion of the front of the cabinet 10. The outside air flowing into the machine room 30 passes through the condensing heat exchanger 32 to achieve the heat-exchanging process. At this time, since the blocking member 37 is provided between the condensing heat exchanger 32 and the inner walls of the machine room 30, most of the outside air passes through the condensing heat exchanger 32, thereby achieving the heat exchanging process.

Air which has absorbed heat from the condensing heat exchanger 32, is discharged to the rear of the cabinet 10 through the air outlet holes 34 which are provided on the rear surface of the cabinet 10, by a blowing force of the blowing fan 33.

The air, which has absorbed heat from the condensing heat exchanger 32, may pass through the through hole 36*a* in which the blowing fan 33 may be mounted. Thereafter, the air which passes through the through hole 36*a* can be discharged through the air outlet holes 34, which are formed on the rear wall of the cabinet 10, to the outside.

As described above, the kimchi refrigerator is provided, which is designed such that a machine room is defined under one of many storage compartments in a direction from the front to the rear of the refrigerator, thus enlarging the interior storage space of the storage compartment under which the machine room is not defined, thereby effectively using the interior storage space of the refrigerator.

Furthermore, a kimchi refrigerator is provided, which is designed such that the outside air is sucked from the front of the refrigerator, and thereafter is discharged to the rear of the refrigerator after passing through a condensing heat exchanger, thus preventing the discharged air from being sucked into the kimchi refrigerator again, and thereby improving heat exchanging efficiency of the condensing heat exchanger.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A kimchi refrigerator, comprising:

a cabinet;

two or more storage compartments provided in the cabinet to store kimchi; and a machine room provided in the cabinet to house electrical devices, wherein said machine room is arranged from a front to a rear of the cabinet at a position under one of the two or more storage compartments which are arranged side-by-side.

2. The kimchi refrigerator according to claim 1, wherein one or more storage compartments under which the machine room is not defined are formed such that a bottom of each of the one or more storage compartments is deeper than a bottom of the one storage compartment which is positioned above the machine room.

3. The kimchi refrigerator according to claim 2, wherein said machine room includes:

a compressor compressing a refrigerant;

a condensing heat exchanger transferring heat to outside air flowing into the machine room to condense the refrigerant; and a blowing fan sucking the outside air into the machine room and discharging the outside air passing through the condensing heat exchanger to an outside.

4. The kimchi refrigerator according to claim 3, further comprising:

a refrigerant pipe installed on an outside wall of each of the storage compartments so as to serve as an evaporating heat exchanger to cool the two or more storage compartments, thereby cooling the kimchi; and an electric heating wire installed so as to surround the outside wall of each of the storage compartments to heat the two or more storage compartments, thereby ripening the kimchi.

5. The kimchi refrigerator according to claim 1, wherein said machine room comprises:

a compressor compressing a refrigerant;

a condensing heat exchanger transferring heat to outside air flowing into the machine room to condense the refrigerant; and a blowing fan sucking the outside air into the machine room and discharging the outside air passing through the condensing heat exchanger to an outside.

6. The kimchi refrigerator according to claim 5, wherein the condensing heat exchanger, the blowing fan, and the compressor are sequentially arranged in the machine room in a direction from the front of the machine room to the rear of the machine room.

7. The kimchi refrigerator according to claim 6 further comprising:

air inlet holes provided on a lower portion of the front of the machine room so as to suck the outside air into the machine room; and air outlet holes provided at the rear of the machine room to allow air to pass the condensing heat exchanger and be discharged to the outside.

8. The kimchi refrigerator according to claim 7 wherein the air inlet holes are provided on a front of a lower surface of the cabinet defining a lower surface of the machine room, and the air outlet holes are provided on a lower portion of a rear surface of the cabinet defining a rear surface of the machine room.

9. The kimchi refrigerator according to claim 7, further comprising:

a subsidiary air inlet hole provided at a predetermined position on a lower portion of the machine room so as to sufficiently suck the outside air into the machine room; and a guide rib provided at a position around the subsidiary air inlet hole so as to guide the outside air to the condensing heat exchanger.

10. The kimchi refrigerator according to claim 6, further comprising:

a guide member provided between the condensing heat exchanger and the compressor to close a gap between the blowing fan and inner walls of the machine room with a through hole being formed in the guide member so as to allow the blowing fan to be mounted in the through hole.

11. The kimchi refrigerator according to claim 6, further comprising:

a blocking member provided in the machine room, such that the blocking member closes a gap between the condensing heat exchanger and inner walls of the machine room, allowing the outside air flowing into the machine room to pass through the condensing heat exchanger.

12. A kimchi refrigerator including a cabinet with a machine room therein to house electrical devices, comprising:

two or more storage compartments provided in the cabinet to store kimchi, said machine room arranged from a front to a rear of the cabinet at a position under only one of the two or more storage compartments.

13. The kimchi refrigerator according to claim 12, wherein each of the two or more storage compartments other than the one adjacent storage compartment has a bottom which is deeper than a bottom of the one adjacent storage compartment adjacent to the machine room.

14. The kimchi refrigerator according to claim 12, wherein each of the two or more storage compartments other than the one adjacent storage compartment has a storage space which is larger than a storage space of the one adjacent storage compartment adjacent to the machine room.

15. The kimchi refrigerator according to claim 14, wherein the machine room comprises:

a compressor compressing a refrigerant;

a condensing heat exchanger transferring heat to outside air flowing into the machine room to condense the refrigerant; and a fan sucking the outside air into the machine room and discharging the outside air passing through the condensing heat exchanger to an outside of the kimchi refrigerator.

16. The kimchi refrigerator according to claim 12, wherein the machine room comprises:

a compressor compressing a refrigerant;

a condensing heat exchanger transferring heat to outside air flowing into the machine room to condense the refrigerant; and a fan sucking the outside air into the machine room and discharging the outside air passing through the condensing heat exchanger to an outside of the kimchi refrigerator.

17. The kimchi refrigerator according to claim 16, wherein the machine room is sequentially arranged in an order of the condensing heat exchanger, the fan, and the compressor in a direction extending along a line from the front of the machine room to the rear of the machine room.

18. The kimchi refrigerator according to claim 17, wherein the cabinet includes a first wall portion and a second wall portion to define the machine room, the second wall portion of the cabinet being opposite the first wall portion of the cabinet, the kimchi refrigerator further comprising:

an air inlet hole provided through the first wall portion of the cabinet to suck the outside air into the machine room; and an air outlet hole provided through the second wall portion to allow air to pass the condensing heat exchanger and be discharged to an outside of the kimchi refrigerator.

19. The kimchi refrigerator according to claim 18, further comprising:

a guide member with a through hole formed therein to mount the fan, the guide member being provided between the condensing heat exchanger and the compressor such that the outside air passes through the through hole when sucked by the fan which is mounted in the through hole.

20. The kimchi refrigerator according to claim 18, further comprising:

a blocking member provided in the machine room, such that the blocking member closes a gap between the condensing heat exchanger and inner walls of the machine room, allowing the outside air flowing into the machine room to pass through the condensing heat exchanger.

21. The kimchi refrigerator according to claim 18, wherein the guide member partitions an internal space of the machine room into two sections so as to enable the fan to move the outside air in the machine room.

22. The kimchi refrigerator according to claim 20, further comprising:

a subsidiary air inlet hole provided at a predetermined position in a vicinity of the condensing heat exchanger to suck the outside air into the machine room; and a guide rib provided at a position around the subsidiary air inlet hole to guide the outside air to the condensing heat exchanger.

23. The kimchi refrigerator according to claim 5, wherein the condensing heat exchanger, the compressor, and the blowing fan are sequentially arranged in the machine room in a direction from the front of the machine room to the rear of the machine room.

24. The kimchi refrigerator according to claim 12, further comprising:

a condensing heat exchanger disposed in the machine room, wherein outside air is sucked from the front of the refrigerator and is discharged to the rear of the refrigerator after passing through the condensing heat exchanger.

25. The kimchi refrigerator according to claim 16, wherein the condensing heat exchanger, the compressor, and the fan are sequentially arranged in the machine room in a direction from the front of the machine room to the rear of the machine room.

26. The kimchi refrigerator according to claim 18 wherein the air inlet hole is provided on a front of a lower surface of the cabinet defining a lower surface of the machine room, and the air outlet hole is provided on a lower portion of a rear surface of the cabinet defining a rear surface of the machine room.

27. A refrigerator including a cabinet with a machine room therein to house electrical devices, comprising:

two or more storage compartments provided in the cabinet;

wherein the machine room is arranged adjacent only one of the two or more storage compartments such that a storage space of the one adjacent storage compartment is less than any other storage compartment of the two or more storage compartments.

28. The refrigerator according to claim 27, wherein each of the two or more storage compartments other than the one adjacent storage compartments has an identical storage space.

29. A refrigerator including a cabinet with a machine room therein to house electrical devices, comprising:

a fan to move outside air through the machine room such that the outside air is sucked into the machine room from outside the kimchi refrigerator at one side thereof and discharged from the machine room to the outside of the kimchi refrigerator at an opposite side thereof; and two or more storage compartments provided in the cabinet, wherein an internal space of the machine room is partitioned into first and second sections to enable the fan to move air in the machine room.

30. A refrigerator including a cabinet comprising:

a machine room in the cabinet to house electrical devices including:

a condensing heat exchanger, a fan and a compressor, the machine room being sequentially arranged in an order of the condensing heat exchanger, the fan and the compressor in a direction extending along a line from a front of the machine room to a rear of the machine room to suck outside air through the machine room, wherein the fan moves outside air through the machine room such that the outside air is sucked into the machine room from outside the kimchi refrigerator at one side thereof and discharged from the machine room to the outside of the kimchi refrigerator at an opposite side thereof.

31. The refrigerator according to claim 30, further comprising:

two or more storage compartments, one of the two or more storage compartments is adjacent to the machine room and the remaining storage compartments of the two or more storage compartments have a storage space which is larger than a storage space of the one adjacent storage compartment adjacent to the machine room.

32. The refrigerator according to claim 30, wherein the fan sucks the outside air into the machine room from one side of the refrigerator and discharging the outside air passing through the condensing heat exchanger to an outside of the refrigerator from an opposite side of the refrigerator.

33. The refrigerator according to claim 32, wherein the cabinet includes a first wall portion and a second wall portion to define the machine room, the second wall portion of the cabinet being opposite the first wall portion of the cabinet, the refrigerator further comprising:

an air inlet hole provided through the first wall portion of the cabinet to suck the outside air into the machine room; and an air outlet hole provided through the second wall portion to allow the outside air to pass the condensing heat exchanger and be discharged to an outside of the refrigerator.

34. A refrigerator including a cabinet with a machine room therein to house electrical devices, comprising:

two or more storage compartments provided in the cabinet, the machine room under less than all of the storage compartments and the storage compartments, which do not have the machine room thereunder, have a larger space or are deeper than the storage compartments which have the machine room thereunder.

* * * * *